US012102278B2

(12) United States Patent
Scheringer

(10) Patent No.: US 12,102,278 B2
(45) Date of Patent: Oct. 1, 2024

(54) MODULAR SYSTEM FOR LOADING A CONVEYOR DISHWASHER

(71) Applicant: MEIKO Maschinenbau GmbH & Co. KG, Offenburg (DE)

(72) Inventor: Stefan Scheringer, Offenburg (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 289 days.

(21) Appl. No.: 17/784,944

(22) PCT Filed: Dec. 11, 2020

(86) PCT No.: PCT/EP2020/085674
§ 371 (c)(1),
(2) Date: Jun. 13, 2022

(87) PCT Pub. No.: WO2021/116363
PCT Pub. Date: Jun. 17, 2021

(65) Prior Publication Data

US 2023/0012018 A1 Jan. 12, 2023

(30) Foreign Application Priority Data

Dec. 12, 2019 (DE) ..... 102019219439.7

(51) Int. Cl.
*A47L 15/24* (2006.01)
*A47L 15/00* (2006.01)

(52) U.S. Cl.
CPC ..... *A47L 15/247* (2013.01); *A47L 15/0076* (2013.01)

(58) Field of Classification Search
CPC ... A47L 15/247; A47L 15/0076; A47L 15/245
See application file for complete search history.

(56) References Cited

U.S. PATENT DOCUMENTS

2010/0043834 A1 2/2010 Scheringer
2018/0036889 A1 2/2018 Birkmeyer et al.
(Continued)

FOREIGN PATENT DOCUMENTS

DE 1956049 A 5/1971
DE 1956050 A 5/1971
(Continued)

OTHER PUBLICATIONS

International Search Report; European Patent Office; International Application No. PCT/EP2020/085674; Mar. 1, 2021; 5 pages.
(Continued)

*Primary Examiner* — Natasha N Campbell
(74) *Attorney, Agent, or Firm* — Taft Stettinius & Hollister LLP

(57) ABSTRACT

The invention proposes a modular system for loading a conveying apparatus of a conveyor dishwasher. The modular system comprises: A. at least one detection module for sensing status data relating to supplied washware; B. a plurality of interchangeable handling modules, wherein the handling modules are each intended to perform an individual handling function for handling the washware using at least one actuator; C. at least one feeding unit for selectively feeding the supplied washware to the handling modules; D. at least one control module, wherein the control module has at least one registering unit, wherein the handling modules and the individual handling function thereof can be registered, and deregistered, at the registering unit, wherein the control module has at least one processor and is programmed to evaluate the status data and to assess a respective situation of the supplied washware; and to detect which handling modules are registered at the registering unit, whether the respective individual handling function of the handling modules is usable in the respective washware
(Continued)

situation, and to activate the feeding unit such that washware is fed to the handling modules in accordance with the usability. The invention also proposes a cleaning system which comprises the modular system, and further proposes a method for cleaning washware.

15 Claims, 3 Drawing Sheets

(56) References Cited

U.S. PATENT DOCUMENTS

| | | | |
|---|---|---|---|
| 2019/0127152 | A1 | 5/2019 | Wu et al. |
| 2019/0167068 | A1 | 6/2019 | Yoon et al. |

FOREIGN PATENT DOCUMENTS

| | | | |
|---|---|---|---|
| DE | 2443651 | A1 | 4/1976 |
| DE | 3413480 | A1 | 10/1985 |
| DE | 102004056052 | A1 | 6/2006 |
| DE | 102007025263 | A1 | 10/2007 |
| DE | 102019102800 | A1 | 8/2020 |
| DE | 102019102813 | A1 | 8/2020 |
| EP | 0292773 | A2 | 11/1988 |
| EP | 2158833 | A2 | 3/2010 |
| WO | 2018031489 | A1 | 2/2018 |

OTHER PUBLICATIONS

Written Opinion of the International Searching Authority; European Patent Office; International Application No. PCT/EP2020/085674; Mar. 1, 2021; 18 pages.

International Preliminary Report on Patentability; The International Bureau of WIPO; International Application No. PCT/EP2020/085674; Jun. 23, 2022; 20 pages.

MODULAR SYSTEM FOR LOADING A CONVEYOR DISHWASHER

CROSS-REFERENCE TO RELATED APPLICATIONS

This application is a U.S. National Phase of International PCT Application No. PCT/EP2020/085674, which was filed on Dec. 11, 2020, and which claims priority to German Patent Application No. 102019219439.7, which was filed on Dec. 12, 2019. The contents of each of those applications are incorporated herein by reference in their entireties.

TECHNICAL FIELD

The invention relates to a modular system for loading a conveying device of a conveyor dishwasher, and to a cleaning system for cleaning washware, comprising the modular system. Furthermore, the invention relates to a method for cleaning washware using the cleaning system. By way of example, systems and methods of the aforementioned type can be used in the field of dishwasher technology, especially in the field of commercial dishwasher technology. Thus, the invention can be used in commercial kitchens, in particular, where washware, for example trays, tableware and flatware, has to be cleaned in relatively large quantities. In particular, the invention can be used in conveyor dishwashers, for example belt conveyor dishwashers. However, other fields of use are also conceivable as a matter of principle.

TECHNICAL BACKGROUND

The prior art has disclosed a multiplicity of cleaning devices, which are also referred to as cleaning appliances and which are able to clean and/or disinfect washware. Without restricting further possible embodiments, the invention is described below with reference to washware which serves to give, prepare or store food. The embodiment of these cleaning devices depends significantly overall on the various boundary conditions, for example the type of washware to be cleaned, the dirtying, the throughput or similar conditions. By way of example, reference can be made to cleaning devices which are described in DE 10 2004 056 052 A1 or DE 10 2007 025 263 A1, for example.

By way of example, the washware may comprise a tray which is loaded with tableware, flatware, food remains and a napkin. In this case, the tableware for example may comprise a plate, a soup bowl, a desert bowl, a salad bowl, a cup and a drinking glass, or may comprise only a selection of these options. Additionally, warming vessels and an associated cover for the plate, for example, may be present, especially in hospitals or care establishments. These warming vessels are also referred to as cloches. Together with a tray, these items are also referred to as a place setting. The occurrence and the distribution of these parts can be very uniform, for example in a prison canteen. However, very variable compositions of the place settings may occur, for example if there is a broad choice of food in company canteens or university refectories. There may also be variability over time, for example in the difference between breakfast, lunch and dinner.

The flatware can usually comprise a knife, a fork, a soup spoon and a small spoon, or merely a selection of the aforementioned flatware items. Depending on country-specific conditions, variations in the place setting and also in the food remains may be present or to be expected. The composition of the food remains may also be very different, for example from small remains of gravy on the plate to remains of the actual meal in all vessels up to virtually fully filled vessels. Additionally, there also are for example food remains that usually cannot be eaten, especially bones, fish bones, shellfish shells, stones, wooden skewers or similar objects.

In conventional canteen kitchens, the washware is processed in various stages. The use of a conveyor dishwasher is described below in exemplary fashion. Thus, the loaded trays can initially be transported from the dining room into the dishwasher, for example by means of cars or else by means of conveyor systems such as conveyor belts. The trays can subsequently be separated, for example by hand or else by machine. Subsequently, disruptive parts can be removed and drinking glasses can be cleared. By way of example, drinking glasses can be emptied and inserted into special drinkware baskets or directly onto a conveyor belt of the dishwasher. Furthermore, the tableware items can be oriented appropriately so that these can be optimally held by the conveyor belt of the dishwasher and can be cleaned correctly. However, before the tableware is put into the dishwasher, food remains must, as a rule, be removed therefrom and must be disposed in such a way that the work surroundings are not contaminated. As a rule, flatware items are aligned and positioned in flatware baskets or flatware receptacles or else directly on the conveyor belt of the dishwasher. Furthermore, food remains and napkins must, as a rule, be cleared from the tray and be disposed, in such a way that the work surroundings are not contaminated. Subsequently, the trays are as a rule inserted into the dishwasher, said trays being aligned individually in relation to the conveyor belt of the dishwasher so that they can be optimally received by the dishwasher and can be cleaned correctly.

There are a number of options for cleaning the place setting. For example, all parts could be processed in a single dishwasher. In this case, the conveying device of the dishwasher, for example, can be divided into a plurality of lanes which are each designed on an individual basis for a type of washware. By way of example, provision can be made for a lane for drinkware, a lane for trays, and one or more further lanes for different types of tableware. The arrangement and design of the lanes can be matched to the commercial requirements. Such dishwashers with a plurality of lanes are frequently also referred to as multi-lane dishwashers. As an alternative to the use of a single dishwasher, it is also possible to use separate dishwashers. By way of example, provision can be made for a dishwasher for drinkware, which is collected in baskets for example, and/or a separate tray dishwasher for trays. By way of example, the tray dishwasher can be arranged back-to-back to the dishwasher for tableware.

Individual or several of the aforementioned process steps can also be carried out automatically as an alternative to a manual implementation. Thus, DE 1 956 050 A describes a pre-clearing apparatus for equipping dishwashers with food plates and food trays, to be cleaned, from large-scale canteen kitchens. US 2019/0127152 A1 describes a conveying and loading device. Furthermore, fully automated installations which are able to carry out the aforementioned steps and/or parts of the aforementioned steps are also known. By way of example, reference should be made to DE 1 956 049 A, DE 2 443 651 A1 or else DE 3 413 480 A1 in this respect. Moreover, devices with robots are also known. Reference can be made to US 2019/0167065 A1, US 2019/0167068 A1 or else WO 2018/031489 A1. By way of example, use can be made of magnetic flatware or else magnetic tableware, which is magnetically separated from the remaining tableware.

DE 10 2019 102 800 A1 discloses a system for loading the dishwasher, which is embodied as a commercial conveyor dishwasher in particular. The system comprises a feed conveyor belt for feeding washware to a loading region of the conveyor dishwasher. The system further comprises a sorting arrangement for sorting the washware, which is fed to the loading region of the conveyor dishwasher via the feed conveyor belt, according to washware groups that are defined or definable in advance. The sorting arrangement is assigned at least one loading arrangement for automatically loading the conveyor dishwasher with washware of one of the washware groups defined or definable in advance.

DE 10 2019 102 813 A1 discloses an unloading arrangement for unloading washware items, especially washware items of place settings, arranged on trays or tray-like objects in particular.

The unloading arrangement comprises a feeding conveyor belt for feeding the washware items which are arranged on trays or tray-like objects in particular and which are to be unloaded. The unloading arrangement further comprises a multiplicity of unloading stations that are arranged successively—as seen in the conveying direction of the feeding conveyor belt. For successively unloading the feeding conveyor belt or for successively unloading the trays or the tray-like objects, each unloading station is preferably assigned a washware group defined or definable in advance and each unloading station is designed to preferably exclusively unload washware items of the washware group assigned thereto from the washware fed via the feeding conveyor belt.

Despite the advantages obtained by the devices described above, there still are numerous technical and organizational challenges. In particular, planning the need for staff and adapting machines, automation and staff to the actual situation still represents a technical, organizational and economical problem. In particular, over-dimensioning or under-dimensioning of the devices must be avoided while the staffing needs must be planned correctly and sufficiently for any situation at the same time.

Thus, numerous manual interventions are often required in conventional devices for processing the individual process steps. This may lead to the performance of the human staff determining the limits of the processing capacity of the overall washing apparatus. Then, as a rule, one or more members of staff must be employed in front of the dishwasher depending on the amount of washware per unit time. This use of staff requires space and costs money. Furthermore, a lack of staff may play an important role in this context. Moreover, the work conditions for the dishwasher staff are often burdensome since increased temperatures and usually also an increased humidity may occur. Noise, smells, monotony and drafts may also increase the burden. On the other hand, the dishwasher and the coupled conveying systems generally specify a cycle that has to be observed by the staff in order to ensure a disturbance-free process flow. Otherwise, the cleaning process may come to a standstill, which may for example lead to no further trays being able to be dropped off.

Partly automated solutions may reduce the running costs since individual process steps can be carried out by automated devices, thus allowing staff to be economized. Fully automated solutions are also able to reduce costs. However, in practice, the known partly automated or else fully automated apparatuses are very complex in many cases on account of the multiplicity of tasks that have to be carried out by these apparatuses. Then again, these apparatuses are however inflexible as a rule since they often have to be matched specifically to the place settings available. If there are changes in the place setting, the automated or partly automated apparatus must generally be retrofitted or upgraded. From a technical and economical point of view, there often is only a small scope for such changes in existing apparatuses. Thus, as a rule, planning and implementation only offers the choice between the use of staff, which could be used flexibly but nevertheless causes significant costs and makes high demands in respect of space and ergonomics, and the use of partly automated or automated solutions, which however are inflexible.

PROBLEM OF THE INVENTION

It would therefore be desirable to provide devices and methods for cleaning washware, which at least largely avoid the above-described disadvantages of known devices and methods of the specified type. In particular, the apparatuses and methods should firstly ensure a high throughput when cleaning washware and secondly have great cost efficiency and great flexibility in view of changing cleaning situations.

GENERAL DESCRIPTION OF THE INVENTION

The problem is addressed by a modular system for loading a conveying device of a conveyor dishwasher, by a cleaning system, and by a method for cleaning washware, having the features of the independent claims. Advantageous developments, which are realizable individually or in any combination, are represented in the dependent claims.

In the text which follows, the terms "exhibit", "have", "comprise" or "include" or any grammatical departures therefrom are used non-exclusively. Accordingly, these terms can refer either to situations in which, besides the features introduced by these terms, no further features are present, or to situations in which one or more further features are present. For example, the expression "A exhibits B", "A has B", "A comprises B" or "A includes B" can refer either to the situation in which, apart from B, no further element is present in A (i.e., to a situation in which A exclusively consists of B), or to the situation in which, in addition to B, one or more further elements are present in A, for example element C, elements C and D or even further elements.

Furthermore, it should be noted that the terms "at least one" and "one or more" and grammatical modifications of these terms, if they are used in association with one or more elements or features and are intended to express the fact the element or feature can be provided singularly or multiply, generally are used only once, for example when the feature or element is introduced for the first time. When the feature or element is subsequently mentioned again, the corresponding term "at least one" or "one or more" is generally no longer used, without restricting the possibility that the feature or element can be provided singularly or multiply.

Furthermore, in the text which follows, the terms "preferably", "in particular", "for example" or similar terms are used in conjunction with optional features, without alternative embodiments being restricted thereby. In this regard, features which are introduced by these terms are optional features, and the scope of protection of the claims, and in particular of the independent claims, is not intended to be restricted by these features. In this regard, the invention, as will be recognized by the person skilled in the art, can also be carried out using other configurations. In a similar way, features which are introduced by "in one embodiment of the invention" or by "in one exemplary embodiment of the invention" are understood as optional features, without alternative configurations or the scope of protection of the independent claims being intended to be restricted thereby. Furthermore, all possibilities of combining the features introduced by these introductory expressions with other features, be they optional or non-optional features, are intended to remain unaffected by these introductory expressions.

In a first aspect of the present invention, a modular system for loading a conveying device of a conveyor dishwasher is proposed. The modular system comprises:

A. at least one detection module for acquiring state data of supplied washware;

B. a plurality of interchangeable handling modules, the handling modules each being configured to carry out an individual handling function for handling the washware using at least one actuator;

C. at least one feeding unit for selectively feeding the supplied washware to the handling modules; and D. at least one control module.

The control module comprises a registration unit. The handling modules and their individual handling functions are registrable, and deregistrable, at the registration unit. The control module comprises at least one processor and is configured, by programming, to evaluate the state data and assess a respective washware situation of the supplied washware; and to recognize which handling modules are registered to the registration unit, whether the respective individual handling functions of handling modules are utilizable in the respective washware situation, and to drive the feeding unit in such a way that washware is fed to the handling modules according to utilizability.

The term "system" as it is used here is a further term which is to be accorded its usual and common meaning as it is understood by a person skilled in the art. The term is not restricted to a specific or adapted meaning. Without restriction, the term may in particular relate to a unit composed of at least two components, the components being configured to functionally interact for the purposes of attaining at least one purpose of the system. In this case, the components can be interconnected, especially reversibly interconnected, mechanically and/or electrically.

The term "modular system" as it is used here is therefore likewise a further term which is to be accorded its usual and common meaning as it is understood by a person skilled in the art. The term is not restricted to a specific or adapted meaning. Without restriction, the term may in particular relate to a system within the meaning of the aforementioned definition, which system comprises at least two system components in the form of interchangeable modules such that, for example, at least one first module is alternatively combinable with at least one second module or with at least one third module. The term "module" as it is used here is therefore likewise a further term which is to be accorded its usual and common meaning as it is understood by a person skilled in the art. The term is not restricted to a specific or adapted meaning. Without restriction, the term may relate in particular to an interchangeable system component, which in particular can implement at least one module function. Standardized interfaces, for example mechanical and/or electrical interfaces, may for example be provided on the modules for the purposes of producing the modularity. Accordingly, the modular system may comprise at least one base component which is couplable to a plurality of interchangeable modules. The term "interchangeable" as it is used here is a further term which is to be accorded its usual and common meaning as it is understood by a person skilled in the art. The term is not restricted to a specific or adapted meaning. Without restriction, the term may relate in particular to a property of a system having a plurality of system components, in the case of which at least one of the system components can be removed from the system and be replaced by another system component, with the system remaining functional and at least one system function optionally being changed, for example in accordance with functionality of the interchanged system components.

The term "loading" as it is used here is likewise a further term which is to be accorded its usual and common meaning as it is understood by a person skilled in the art. The term is not restricted to a specific or adapted meaning. Without restriction, the term may relate in particular to a procedure, within the scope of which at least one type of ware, especially washware in this case, is introduced into a device or applied to a device. In particular, loading can be implemented fully or partly automatically.

The term "conveying device" as it is used here is likewise a further term which is to be accorded its usual and common meaning as it is understood by a person skilled in the art. The term is not restricted to a specific or adapted meaning. Without restriction, the term may relate in particular to a device which is configured to convey at least one other device or at least one other element, especially washware, and/or to drive a movement of the other device or of the other element. The conveying device may in particular comprise at least one drive element, for example at least one drive element which runs in the circuit through the cleaning chamber. In particular, the conveying device, for example the drive element, can comprise at least one element selected from the group consisting of :a conveyor belt, transport casters, in particular driven transport casters, a link chain, a catch conveying system. By way of example, conveyance in this case may be implemented continuously or else discontinuously or in cycles, and so for example use can be made of continuously operating conveyor dishwashers or else dishwashers operating in cycles. By way of example, the conveying direction may be a main direction of movement of the washware within a cleaning chamber of the conveyor dishwasher. The conveying direction may be fixedly prescribed or may also change, for example locally or else temporally. By way of example, the conveying direction may be directed from an inlet of the conveyor dishwasher to an outlet.

The term "dishwasher", also referred to in general as a "cleaning device", as it is used here is a further term which is to be accorded its usual and common meaning as it is understood by a person skilled in the art. The term is not restricted to a specific or adapted meaning. Without restriction, the term may relate in particular to a device that is configured to free washware from adhering macroscopic or else microscopic contamination, or to at least partly remove such contamination. Additionally, there may be an optional disinfectant effect. In particular, the dishwasher can be embodied as a dishwasher for tableware.

Accordingly, the term "conveyor dishwasher" as it is used here is a further term which is to be accorded its usual and common meaning as it is understood by a person skilled in the art. The term is not restricted to a specific or adapted meaning. Without restriction, the term may in particular relate to a dishwasher within the meaning of the definition given above which comprises at least one conveying device.

In particular, the conveyor dishwasher may comprise at least one cleaning chamber, for example at least one cleaning tunnel, within which at least one cleaning fluid is applied to the washware, in particular by means of at least one application device as will be explained in more detail below. The conveying device may be configured to convey the washware through the cleaning chamber.

The term "washware" as it is used here is a further term which is to be accorded its usual and common meaning as it is understood by a person skilled in the art. The term is not restricted to a specific or adapted meaning. Without restriction, the term may relate to any objects that can be cleaned by means of the cleaning device. In this case, one object may be cleaned or a plurality of objects may be cleaned simultaneously or sequentially. In particular, the washware may relate to objects that are used directly or indirectly for the preparation, storage or giving of meals, that is to say for example tableware, flatware, trays, bowls, glasses, cups, pots, pans, or similar objects. Accordingly, the cleaning device may be embodied as a dishwasher for tableware in particular, for example as a dishwasher for tableware for commercial use in canteens or kitchens for mass catering. Other embodiments of the cleaning device and/or of the washware are also possible as a matter of principle.

The term "supply" as it is used here is a further term which is to be accorded its usual and common meaning as it is understood by a person skilled in the art. The term is not restricted to a specific or adapted meaning. Without restriction, the term may relate in particular to a procedure within the scope of which washware to be cleaned is manually or automatically provided for the conveying device and/or the conveyor dishwasher. By way of example, this procedure can be implemented by virtue of washware being supplied automatically to the conveying device and/or the conveyor dishwasher by means of a conveyor belt or any other feed device. However, there may also alternatively be a manual supply.

The term "detection module" as it is used here is a further term which is to be accorded its usual and common meaning as it is understood by a person skilled in the art. The term is not restricted to a specific or adapted meaning. Without restriction, the term may relate in particular to a module of the system, within the meaning of the definition above, which is configured to acquire the state data relating to the supplied washware. In particular, the detection module may comprise at least one sensor that is configured to acquire the state data relating to the supplied washware. In particular, this may relate to at least one sensor selected from the group consisting of: an optical sensor, in particular a camera; a magnetic sensor; a mechanical sensor, in particular a probe. The detection module may have dedicated intelligence, for example in the form of at least one processor. Alternatively, however, the detection module may only have sensor-type properties and may be configured for example to transfer state data, in particular to the control module to be described in more detail below. Hence, the detection module may comprise at least one interface in particular, the latter being able to have a wired or else a wireless embodiment.

The term "state data" as it is used here is a further term which is to be accorded its usual and common meaning as it is understood by a person skilled in the art. The term is not restricted to a specific or adapted meaning. Without restriction, the term may relate in particular to any data that directly or indirectly describe the state of the washware. By way of example, these data may be raw data which are subsequently still processed further and/or evaluated by the control module, as will be explained in more detail below. Alternatively, these state data may also already be at least partly evaluated. In general, the state data may include at least one information item selected from the group consisting of: a type of washware; a dimension of the washware; an amount of the washware; a composition of the washware; a relative spatial position and/or orientation of the washware; a degree of dirtying of the washware; disruptive parts on or at the washware. The state data may be acquired continuously or else discontinuously, for example in state data packets. The state data may also be assigned to certain units of the washware. By way of example, the washware may be subdivided into units which each comprise at least one tray and a load on the tray. Thus, the load may for example comprise tableware and/or flatware, and optionally disruptive parts and contaminations. The state data may in each case be acquired as a common unit, for example as a data packet, for a tray or else a stack of trays with objects arranged thereon. However, in an alternative the state data may initially be acquired continuously and may subsequently be subdivided into packets corresponding to a tray or a stack of trays with objects arranged thereon, for example in the detection module and/or in the control module.

The term "handling module" as it is used here is a further term which is to be accorded its usual and common meaning as it is understood by a person skilled in the art. The term is not restricted to a specific or adapted meaning. Without restriction, the term may relate in particular to a module, in particular an interchangeable unit, which is configured to carry out an individual handling function for handling the washware using at least one actuator. This handling function may be individual to the respective handling module such that, for example, other handling modules have different handling functions. However, a plurality of handling modules of the same type and with the same individual handling function may also be provided in an alternative.

The term "handling function" as it is used here is a further term which is to be accorded its usual and common meaning as it is understood by a person skilled in the art. The term is not restricted to a specific or adapted meaning. Without restriction, the term may relate in particular to a procedure within which the washware is handled in one or more specific ways. By way of example, this handling may be selected from the group consisting of: a reorientation of the washware; a placement of the washware; a sorting of the washware; an emptying of the washware; a reception of the washware in at least one conveying device such as a cleaning basket, for example; a removal of disruptive parts from the washware. In turn, the handling module may for example comprise a dedicated intelligence, for example by virtue of the handling module comprising at least one processor. Alternatively, the handling module may however also be embodied without dedicated intelligence. The handling module may comprise at least one drive for driving the at least one actuator. Furthermore, the handling module may comprise at least one module controller for controlling the operation of the actuator.

The handling modules each comprise at least one actuator for carrying out these individual handling functions, for which the respective handling module is configured. The term "actuator" as it is used here is a further term which is to be accorded its usual and common meaning as it is understood by a person skilled in the art. The term is not restricted to a specific or adapted meaning. Without restriction, the term may relate in particular to any device that is configured to act on at least one object in at least one way. By way of example, this action may be selected from the group consisting of: a mechanical action, for example a reorientation or a new placement; a magnetic action. Thus, the actuator may for example comprise at least one actuator selected from the group consisting of: a gripper; a pushing means; a brush; a permanent magnet; an electromagnet; a turning means, for example a turning wheel.

The term "feeding unit" as it is used here is a further term which is to be accorded its usual and common meaning as it is understood by a person skilled in the art. The term is not restricted to a specific or adapted meaning. Without restriction, the term may relate in particular to any device that is configured to feed objects to another device in a targeted or controlled manner and/or in order to bring the other device closer to said objects. Consequently, there can be a movement of the objects and/or a movement of the other device. The feeding device may comprise at least one conveying device and/or at least one manipulator, which may bring about the aforementioned feeding function. In particular, this conveying device may comprise at least one pushing means. Alternatively or in addition, other types of conveying device may however also be provided, for example one or more conveyor belts, grippers, or similar devices.

The term "selectively" as it is used here in particular in conjunction with the feeding unit is a further term which is to be accorded its usual and common meaning as it is understood by a person skilled in the art. The term is not restricted to a specific or adapted meaning. Without restriction, the term may relate in particular to the fact that certain types of objects, in particular washware, are fed to certain, specific types of handling modules. Thus, there may be an assignment between the types of washware and the respective handling modules, to which a feed is implemented. If there is no assignment, the feeding unit may be configured to not bring about a feed.

The term "control module" as it is used here is likewise a further term which is to be accorded its usual and common meaning as it is understood by a person skilled in the art. The term is not restricted to a specific or adapted meaning. Without restriction, the term may relate in particular to a one-part or multi-part device that is configured to fully or partly control and/or regulate an operation of the modular system. In particular, the control module can be configured to change, in particular control and/or regulate, one or more operating parameters of the modular system. In particular, the control module may comprise at least one data processing device, for example at least one processor. In particular, the control module may be configured by programming, for example in order to carry out the functions described in more detail below. The control module may be fully or partly realized by hardware, or/also, alternatively or in addition, fully or partly by software. Furthermore, the control module may comprise at least one volatile and/or nonvolatile data memory. Furthermore, the control module may comprise at least one interface, for example a human-machine interface for entering commands and/or for outputting information items, and/or a wireless or wired interface for unidirectional or bidirectional interchange of data and/or commands. In particular, the control module can be a centralized or decentralized machine controller. The control module may be embodied wholly or partly separate from a controller of the conveyor dishwasher, or may be wholly or partly combined with the latter and/or integrated in the latter.

As explained above, the control module comprises at least one registration unit, the handling modules and the individual handling functions thereof being registrable, and deregistrable, at the registration unit. Registration and/or deregistration may optionally be implemented automatically and/or else manually. This function of the control module contributes to the modularity of the modular system. The term "registration module" as it is used here is likewise a further term which is to be accorded its usual and common meaning as it is understood by a person skilled in the art. The term is not restricted to a specific or adapted meaning. Without restriction, the term may relate in particular to at least one component of the control module which is in particular fully or partly designed as hardware and/or software and which registers when a handling module is coupled or registered to the modular system and/or when a handling module is decoupled or deregistered from the modular system, and which comprises the individual handling functions of said handling modules. Alternatively or in addition, the term may relate to at least one component of the control module which is fully or partly designed as hardware and/or in software and which contains registers with regards to which handling modules with which individual handling features are currently coupled and/or registered to the modular system. The term "register" as it is used here is accordingly likewise a further term which is to be accorded its usual and common meaning as it is understood by a person skilled in the art. The term is not restricted to a specific or adapted meaning. Without restriction, the term may relate in particular to a coupling of a component to a system, the coupling adding at least one functionality of the component to the functionality of the system. In particular, the term may relate to coupling by hardware and/or software. In particular, the term may also comprise a registration of the registered component in a register of the system. The registration unit can be configured to automatically register when a handling module is coupled and/or registered to the modular system and/or when a handling module is decoupled and/or deregistered from the modular system, and preferably also the individual handling functions of the respective module.

The control module comprises at least one processor. The term "processor" as it is used here is likewise a further term which is to be accorded its usual and common meaning as it is understood by a person skilled in the art. The term is not restricted to a specific or adapted meaning. Without restriction, the term may relate in particular to basically any logic circuit configured to carry out basic operations of a computer or system, and/or to a device configured to carry out calculations or logic operations. In particular, the processor may be configured to implement basic instructions that control a computer or a computer system. By way of example, the processor may comprise at least one component selected from the group consisting of: an arithmetic logic unit (ALU); a floating-point unit (FPU), such as a mathematical coprocessor or a numerical coprocessor, for example; a plurality of registers, in particular registers configured to supply operands to the ALU and to store results of operations; a memory, in particular a data memory such as an L1 and/or L2 cache data memory, for example. In particular, the processor may comprise a single core or else multiple cores. In particular, the processor may be a central processing unit (CPU) or comprise such a central processing unit. Additionally or as an alternative, the processor may be a microprocessor or comprise a microprocessor such that, in particular, the components of the processor may be comprised by a single integrated circuit chip. Alternatively or in addition, the processor may however also comprise one or more application-specific integrated circuits (ASICs) and/or one or more field-programmable gate arrays (FPGAs) or similar components. In particular, the processor may be configured to carry out one or more evaluation operations, in particular by way of software programming.

As explained above, the control module, in particular the processor, is configured by processing to evaluate the state data and assess a respective washware situation of the supplied washware and to recognize which handling modules are registered to the registration unit, whether the respective individual handling functions of handling modules are utilizable in the respective washware situation, and to drive the feeding unit in such a way that washware is fed to the handling modules according to utilizability.

The term "washware situation" as it is used here is a further term which is to be accorded its usual and common meaning as it is understood by a person skilled in the art. The term is not restricted to a specific or adapted meaning. Without restriction, the term may relate in particular to an information item as to when a specific type of washware is supplied, in which combination and set up and in which state. Consequently, the assessment of the washware situation may relate in particular to a recognition of the washware situation and a selection of appropriate control measures. By way of example, in a manner analogous to the above-described state data, the washware situation can be acquired continuously or else piecewise, for example for a tray or stack of trays with the associated load in each case. By way of example, the cleaning situation may comprise various categories, in particular in view of one or more of the following possible criteria: the type of washware; the type of contamination of the washware, food remains; drink remains; disruptive parts; orientation of the washware. Other criteria are also possible. By way of example, categories of cleaning situations can be specified or created automatically, with respective tasks being able to be assigned to the categories for example. By way of example, in the case of washware comprising disruptive parts, these tasks may include the removal of disruptive parts and, for example, the transfer of the disruptive parts to a collection container. Alternatively or in addition, in the case of tableware with food remains or drink remains, the tasks may comprise the clearing of the tableware into at least one refuse container or at least one disposal shaft. Once again, as an alternative or in addition, the tasks in the case of tableware may comprise a reorientation of the tableware such that the latter is for example transferred to the conveying device of the conveyor dishwasher in a correct orientation. Once again, as an alternative or in addition, the tasks may for example comprise a transfer of trays in a specific orientation to the conveying device. Furthermore, as an alternative or in addition, the tasks may comprise a removal of flatware items and a transfer of the flatware items in a specific orientation to a collection container, for example a flatware basket, or to the conveying device of the conveyor dishwasher. Once again, as an alternative or in addition, the tasks may for example comprise a collection of drinking glasses or cups in a drinkware basket and/or a transfer thereof in a certain orientation to the conveying device. In yet a further alternative or in addition, the categories may also relate to certain lanes of the conveying device such that, for example, specific types of washware can be transferred to specific lanes in a targeted manner. As an alternative or in addition, numerous other categories of washware situations and corresponding tasks to be completed are conceivable.

For the evaluation of the state data and the assessment of the respective cleaning situation of the supplied washware, it is possible, as explained in more detail below, for the control module to have at least one artificial intelligence in particular. In particular, it is possible to use at least one self-learning system, for example an artificial neural network. A categorization of situations represents a typical task for a neural network, for example by virtue of neural network recognizing similarities in the state data, in particular in image data of the state data, and categorizing corresponding situations. However, other options are also conceivable, for example by virtue of implementing pattern recognition and a corresponding assignment to cleaning situations.

The recognition of which handling modules are currently registered to the registration unit can for example be implemented by evaluating at least one data memory of same, for example a register. The application unit may be formed separately from the controller but may also be fully or partly integrated into said controller. The recognition as to whether the respective individual handling function of the handling modules is usable in the respective washware situation may likewise be implemented by categorization, for example. By way of example, if the control module recognizes the presence of at least one specific category of washware situation, it is possible to carry out a check as to whether at least one handling module whose respective handling function corresponds to the at least one task assigned to this category is registered. By way of example, if a category, as explained above, is the removal of disruptive parts or refuse, a check can for example be carried out as to whether at least one handling module which has the individual handling function of separating disruptive parts or refuse is registered. By way of example if, as an alternative or in addition, a category, as explained above, is the removal of flatware, a check can be carried out as to whether at least one handling module which has the individual handling function of separating flatware, especially magnetic flatware, is registered. In general, as explained above, the recognition as to the handling modules registered to the registration unit and as to whether the respective individual handling functions of the handling modules are usable in the respective washware situation can be implemented by a corresponding comparison of tasks and available functionalities. In turn, artificial intelligence can also be used in this case, too, or a conventional algorithm can be used.

In accordance with this recognition, the control unit is configured to drive the feeding unit in such a way that washware is fed to the handling modules in accordance with the usability of the respective handling modules. In this case, at least one feeding unit can be designed to be wholly or partly separate from the handling modules but it may also be wholly or partly integrated in the handling modules. Thus, for example, at least one of the handling modules may have at least one separate feeding unit, by means of which the respective washware is guided to the respective handling module and/or by means of which the respective handling module is brought closer to the respective washware.

By way of example, driving the feeding unit by means of the control unit may be wholly or partly implemented by virtue of commands and/or control signals being transmitted directly or indirectly from the control module to the respective handling module and/or to at least one control unit which drives the respective handling module, for example a current source and/or a voltage source. By way of example, at least one interface, for example a wired and/or wireless interface, may be provided for the transfer of the commands and/or control signals. Alternatively or in addition, provision can be made of at least one bus system.

By the appropriate control of the feeding unit, a supply of washware to the handling modules, that is to say a bringing together of washware and the respective handling module, is rendered selectively possible and/or brought about in accordance with the recognized washware situation. As a result of this selective bringing together, the control unit can cause a bringing together between the respective washware and the handling module only in the case where it is recognized that a handling module is usable in the specific washware situation. By way of example, a corresponding pushing means and/or another type of actuator can be driven to accordingly guide the washware to the suitable handling module, or vice versa.

As explained above, the individual handling functions can be designed very differently, depending on use purpose. In particular, the at least one individual handling function of the handling module can be selected from the group consisting of:

removing disruptive parts from a tray;
removing food remains and napkins from a tray;
clearing drinking glasses from a tray;
clearing flatware items from a tray;
clearing other tableware items from a tray;
providing supplied trays to the conveying device of the conveyor dishwasher;
turning a removed tableware item over and transferring the latter to the conveying device of the conveyor dishwasher;
forwarding a removed tableware item and transferring the latter to the conveying device of the conveyor dishwasher.

Other individual handling functions are alternatively or additionally also possible.

As furthermore explained above, the state data may comprise in particular image data of the supplied washware. Thus, the detection module may for example comprise at least one camera which records images of the supplied washware continuously discontinuously at one or more points. Accordingly, the detection module may for example comprise at least one image acquisition means. However, alternatively or in addition, the image acquisition means may also for example be arranged in the control module, as explained above. In yet a further alternative or in addition to image data, other data may also be acquired by the detection module.

In particular, as explained above, the processor of the control module may comprise at least one image evaluation software. Accordingly, the processor may be configured to recognize and assess the washware situation by means of the image evaluation software. As likewise already explained above, at least one artificial intelligence may also be used in the process. In particular, the artificial intelligence may be trained for different washware situations, for example in order to recognize the above-described categories and/or other categories. Accordingly, the processor in particular may have at least one artificial intelligence, in particular at least one artificial neural network, for assessing the washware situation.

In particular, the control module may be configured to recognize whether the respective washware situation requires at least one type of handling for which no handling module with a suitable individual handling function is registered to the registration unit. Thus, for example, the current cleaning situation may require one or more handling steps for which no handling module is currently registered to the registration unit. By way of example, this may be such a case if disruptive parts for which no handling is provided are recognized, for example within the scope of recognizing a purse, key or banknotes on the tray. Accordingly, the control module may be configured in particular to report this washware to the human staff should one or more handling steps for which no handling module is registered be required, for example by way of an optical and/or acoustic alarm, and/or to feed this washware to a workstation for human staff so that the human staff can carry out the appropriate handling.

In particular, the at least one individual handling function of the handling modules may comprise a provision of at least one selected type of washware to at least one assigned lane of the conveying device of the conveyor dishwasher. As explained above, the conveyor dishwasher may for example be configured in such a way that the conveying device is divided virtually or physically into lanes which in each case extend parallel to a conveying direction of the conveying device. These lanes can be provided physically by virtue of certain subdivisions or different designs being implemented on a belt of the conveying device, for example by virtue of the conveying fingers in the lanes having different designs and/or arrangements. Thus, provision can be made for example for lanes for flatware, drinkware, plates and trays. Other embodiments are also possible. An application device may also differ accordingly in the lanes. By way of example, different types and/or orientations of nozzles could thus be provided in order to impinge different types of washware differently, for example from different directions, with different pressures or else with different cleaning fluids. At least one of the individual functions of the at least two handling modules may in particular consist of recognizing types of washware, for example by the detection module, and then accordingly feeding said types of washware to the associated lanes, for example with a specified orientation, in particular by way of the handling modules.

Alternatively or in addition, at least one of the individual handling functions of the at least two handling modules may comprise a spatial orientation or reorientation of at least one selected type of washware, in particular a turning of the washware or of at least one type of washware. Thus, for example, provision can be made of at least one handling module which turns plates and/or feeds the latter in at least one specified orientation to the conveying device.

At least one of the handling modules may also have feed functions in full or in part. Thus, the functionality of the feeding unit may be wholly or partly adopted by at least one of the handling modules. By way of example, at least one of the handling modules may be embodied in full or in part as a robot, or may comprise a robot. By way of example, this may be a robot which handles drinkware and/or other tableware items. By way of example, these can be taken directly by, for example, the conveying device, for example the conveyor belt, optionally without at least one further feeding unit being required for this handling module. However, alternatively, at least one feeding unit formed separately from the handling modules may be provided in the modular system, said feeding unit selectively feeding washware to at least one of the handling modules. By way of example, separate feeding units may be provided for the handling modules, with for example at least one first feeding unit selectively feeding washware to at least one first handling module and at least one second feeding unit selectively feeding washware to at least one second handling module. However, alternatively or in addition, provision can be made of at least one feeding unit which selectively feeds washware to at least two handling modules.

In particular, the modular system may comprise at least one interface. The interchangeable handling modules may be able to be docked, in particular reversibly, to the interface. By way of example, this interface may ensure at least one mechanical holding function. Furthermore, this interface may also include at least one interface for unidirectional or bidirectional interchange of data and/or control commands between the handling modules and the control module, or vice versa, and furthermore optionally for unidirectional or bidirectional interchange of data and/or control commands between the control module and the detection module, or vice versa. In yet a further alternative or in addition, provision can also be made of at least one interface for supplying the at least one handling module with power.

As explained above, the modular system can be configured in particular to handle washware comprising trays. Consequently, the washware may comprise trays and tableware items on the trays, in particular. Thus, for example, at least one conveying system for supplying dirtied washware may be provided, which comprises trays and additional washware arranged on the trays, as washware. Thus, for example, a tray or stack of trays and further washware arranged thereon, and optionally contamination and disruptive parts may be considered to be a unit of washware in each case, which can be separated by means of the modular system and can be fed to the conveying device of the conveyor dishwasher.

The plurality of interchangeable handling modules may in particular comprise at least one handling module which is configured to carry out an individual handling function in the form of removing disruptive parts from a tray.

Alternatively or in addition, the plurality of interchangeable handling modules may in particular comprise at least one handling module which is configured to carry out an individual handling function in the form of removing food remains and napkins from a tray. In particular, the individual handling function may furthermore comprise at least a disposal of the food remains and napkins in at least one disposal device, for example a device for comminuting, homogenizing and temporarily storing the food remains and/or napkins, and/or a transfer device for discharging said food remains and/or napkins into a pipe system for food remains, into a trash container and/or into disposal shaft.

In yet a further alternative or in addition, the plurality of interchangeable handling modules may comprise at least one handling module which is configured to carry out an individual handling function in the form of clearing drinking glasses from a tray. In particular, the individual handling function may furthermore comprise at least a provision of the drinking glasses to the conveying device of the conveyor dishwasher, this provision in particular being able to be selected from the group consisting of: loading the drinking glasses into drinkware dishwasher baskets; placing the drinking glasses on at least one drinkware lane of the conveying device of the conveyor dishwasher. In particular, the individual handling function may furthermore comprise emptying the drinking glasses, for example into at least one disposal container and/or at least one disposal shaft, and/or emptying into at least one tank of the conveyor dishwasher machine, for example a tank with the lowest degree of purity in a cascade system of tanks.

As yet a further alternative or in addition to the aforementioned options and/or other options, the plurality of interchangeable handling modules may comprise at least one handling module which is configured to carry out an individual handling function in the form of clearing flatware items from the tray. In particular, the individual handling function may furthermore comprise at least a provision of the flatware items to the conveying device of the conveyor dishwasher, selected from the group consisting of: loading the flatware items into flatware dishwasher baskets; placing the flatware items on at least one flatware lane of the conveying device of the conveyor dishwasher. As explained above, at least one magnet, for example, can be used as a manipulator in the process, for example at least one electromagnet and/or at least one permanent magnet.

As yet a further alternative or in addition to the aforementioned options or else other options, the plurality of interchangeable handling modules may comprise at least one handling module which is configured to carry out an individual handling function in the form of clearing at least one type of tableware item, apart from flatware and drinking glasses, from a tray. Thus, for example, the tableware items selected from the group consisting of plates, cups, bowls, platters or other types of tableware items, which are not flatware or drinking glasses, may be cleared and preferably be fed directly or indirectly to the conveying device. In particular, the individual handling function may furthermore comprise at least a provision of the tableware items to the conveying device of the conveyor dishwasher, selected from the group consisting of: loading the tableware items into tableware dishwasher baskets; placing the tableware items on at least one tableware lane of the conveying device of the conveyor dishwasher.

As explained above, the feeding unit for selectively feeding the supplied washware to the handling modules may generally be configured to bring the handling modules to the washware, and/or vice versa. In particular, the feeding unit may comprise at least one device selected from the group consisting of: a pushing means for selectively pushing constituent parts of the washware to the respective handling modules; a gripper; a brush; a magnet; a slide; a switch; a scraper bar.

In a further aspect of the present invention, a cleaning system for cleaning washware is proposed. The term "cleaning system" as it is used here is a further term which is to be accorded its usual and common meaning as it is understood by a person skilled in the art. The term is not restricted to a specific or adapted meaning. Without restriction, the term may in particular relate to a system within the meaning of the definition given above which serves to clean washware. Accordingly, the term "cleaning" as it is used here is a further term which is to be accorded its usual and common meaning as it is understood by a person skilled in the art. The term is not restricted to a specific or adapted meaning. Without restriction, the term may relate in particular to a procedure during which washware is freed from adhering macroscopic or else microscopic contamination, or such contamination is at least partly removed. Additionally, there may be an optional disinfectant effect.

The cleaning system comprises:

a. at least one modular system according to the present invention, for example according to one or more of the embodiments described above and/or according to one or more of the embodiments to be described in more detail below;
b. at least one conveyor dishwasher, the conveyor dishwasher comprising at least one cleaning chamber and at least one conveying device for conveying washware from an inlet of the conveyor dishwasher to an outlet of the conveyor dishwasher through the cleaning chamber, the conveyor dishwasher being configured to apply at least one cleaning fluid to the washware in the cleaning chamber; and
c. at least one conveying system for supplying dirtied washware.

The term "cleaning chamber" as it is used here is a further term which is to be accorded its usual and common meaning as it is understood by a person skilled in the art. The term is not restricted to a specific or adapted meaning. Without restriction, the term may relate in particular to a fully or partly closed chamber, within which the cleaning procedure is carried out in part or in full. In particular, the cleaning chamber may comprise at least one housing which fully or partly encloses said cleaning chamber. In this case, provision can be made for a single cleaning chamber or, in principle, a plurality of cleaning chambers may also be provided, for example sequentially. By way of example, the cleaning chamber may comprise at least one opening for loading the cleaning chamber with the washware; this at least one opening can also be referred to as an inlet. By way of example, this might be an opening with a flap arranged on a front side of the cleaning chamber and/or a top side of the cleaning chamber. As an alternative, hoods are also possible for closing the cleaning chamber, for example within the scope of what are known as hood-type dishwashers. In yet a further alternative, the cleaning chamber can also be for example wholly or partially configured as a tunnel, for example within the scope of what are known as pass-through dishwashers or conveyor dishwashers, for example as a tunnel with an inlet opening and an outlet opening. Other embodiments are also possible in principle. Accordingly, the terms "inlet" and "outlet" may relate to regions of the conveyor dishwasher and/or the conveying device of the conveyor dishwasher where the washware enters into the cleaning chamber and respectively leaves from the cleaning chamber. By way of example, the conveying device may protrude beyond the cleaning chamber and be freely accessible in these regions.

The conveyor dishwasher is configured to apply at least one cleaning fluid to the washware within the cleaning chamber. To this end, the conveyor dishwasher may comprise at least one application device in particular, especially within the cleaning chamber. The term "application device" as it is used here is a further term which is to be accorded its usual and common meaning as it is understood by a person skilled in the art. The term is not restricted to a specific or adapted meaning. Without restriction, the term may relate in particular to any desired device by means of which the cleaning fluid can be applied to the washware within the cleaning chamber. The application device can in particular comprise at least one nozzle system. Furthermore, the application device can comprise at least one pump, and also at least one line system, for providing cleaning fluid to the nozzle system. By way of example, one nozzle system and one line system for applying cleaning fluid from a tank, and also at least one corresponding pump, can be provided here. Alternatively or in addition, cleaning fluid can also be applied for example to at least one nozzle system directly from a feed line, without a pump being required to this end. One or more cleaning zones, through which the washware passes sequentially for example, can be provided in the cleaning device. By way of example, a single cleaning zone can be provided, the cleaning device being configured to carry out a cleaning program, in which the washware is held stationary in the cleaning chamber and cleaning fluid is applied to said washware in succession in one or more cleaning steps of the cleaning program in different ways, by means of the application device. As an alternative, the washware can also be conveyed in succession through a plurality of cleaning zones in which cleaning fluid is applied in different ways, for example one or more cleaning zones selected from the group consisting of: a pre-clearing zone; a wash zone, a rinse or final rinse zone, said rinse or final rinse zone being able to be subdivided into a pump final rinse zone and a downstream fresh water final rinse zone. Furthermore, at least one drying step can be provided, which drying step for example can follow the application of the cleaning fluid in the one chamber in the case of the washware being held stationary or which drying step can take place in a drying zone which is downstream of the liquid cleaning zones in the case of the conveyor dishwasher for example.

The term "cleaning fluid" as it is used here is a further term which is to be accorded its usual and common meaning as it is understood by a person skilled in the art. The term is not restricted to a specific or adapted meaning. Without restriction, the term may relate in particular to a liquid which can provide a cleaning effect when it makes contact with the washware. In particular, the cleaning fluid can comprise an aqueous liquid, for example water and/or water containing one or more additives, for example containing one or more detergent concentrates and/or final rinse agents and/or disinfectants. The cleaning device can be configured to use a single cleaning fluid or else to use a combination of a plurality of cleaning fluids. If a plurality of cleaning fluids are provided, the different cleaning fluids can be applied to the washware at the same time or else sequentially. For example, the washware can remain stationary within the cleaning chamber and the different cleaning fluids and/or cleaning liquids can be applied to said washware in succession. As an alternative, the washware, as explained above, can also be conveyed sequentially through a plurality of cleaning zones in which for example different types of cleaning fluid and/or cleaning fluids of different grades of purity are applied to said washware. Different grades of purity can be generated for example by a cascade overflow between different tanks of the cleaning device, wherein a degree of purity preferably increases in the conveying direction.

The term "conveying system" as it is used here is a further term which is to be accorded its usual and common meaning as it is understood by a person skilled in the art. The term is not restricted to a specific or adapted meaning. Without restriction, the term may relate in particular to in principle any system that is configured to supply dirtied washware. In this case, this may be a continuous or else a discontinuous system. In particular, it may be an automated system in which washware is supplied automatically. In particular, the conveying system may comprise at least one element selected from the group consisting of: a conveyor belt, transport casters, in particular driven transport casters, a link chain.

In a further aspect, a method for cleaning washware is proposed. The method comprises the steps specified in more detail below. These steps may be carried out in the sequence specified. However, a different sequence is also possible as a matter of principle. Furthermore, two or more of the specified method steps may be carried out with a time overlap or simultaneously. Furthermore, one or more of the specified method steps may be carried out once or else repeatedly. In addition to the specified steps, the method may comprise further method steps not mentioned here.

The method comprises the following steps:

i. providing at least one cleaning system according to the invention, for example according to one or more of the embodiments described above and/or according to one or more of the embodiments to be described in more detail below;
ii. supplying washware by means of the conveying system;
iii. acquiring state data relating to the supplied washware by means of the detection module;
iv. evaluating the state data and assessing the respective washware situation of the supplied washware by means of the control module;

v. recognizing the handling modules registered to the registration unit and the respective individual handling function of the handling modules, and assessing the utilizability in the respective washware situation; and vi. driving the feeding unit by way of the control unit in such a way that the handling modules are fed washware in accordance with the utilizability.

With regard to possible details, definitions and options in respect of the proposed method, reference can be made to the above description of the modular system and of the cleaning system.

The proposed modular system, the proposed cleaning system and the proposed method have numerous advantages over known devices and methods of the specified type. In particular, great flexibility can be ensured as a result of the modularity. Thus, the system can be quickly adapted to corresponding changes in demand. Thus, fundamental overdimensioning can be avoided without an increased risk of a subsequent reinvestment in a larger apparatus, and staffing costs can be reduced efficiently at the same time. Moreover, the modular system reacts flexibly to changing washware situations and in each case recognizes its own current options of the modular system and the usability thereof in the current situation.

Overall, it is possible to reduce staff for processing the place settings upstream of a conveyor dishwasher. In particular, it is also possible to overcome a disadvantage of conventional systems which consists of having to register the situation between dining room and inlet of the dishwasher in its entirety, which may cause great complexity in conventional machines. The proposed modular system allows an analysis to be carried out in respect of the occurring processing steps and, following therefrom, allows a decomposition to be carried out into partial tasks that are as small as possible and hence have little complexity. On the one hand, this procedure provides a holistic view of the system of processing the used place settings. On the other hand, the decomposition of the processing into partial tasks that are as simple as possible generally facilitates good scalability of the type and the number of processing points and processing tools that have to be used in the real task.

Moreover, the proposed invention and, in particular, the division into partial tasks according to the capabilities of the handling modules present allows recognition of potential bottlenecks and disturbances when processing the washware. If staff are still additionally employed, the numbers to be processed manually by the staff can be increased by virtue of partial tasks, for example, being able to be taken away from the staff. Handling modules can be provided for processing the partial tasks of little complexity. Furthermore, whether and which partial tasks cannot be completed and whether and which partial tasks cannot be divided further such that these cannot be worked through by the handling modules can for example be recognized by means of the modular system.

Depending on the respective requirements, it is now possible on an individual basis to put together an assortment of processing points and processing tools in the form of the suitable handling modules. By way of example, this modular system can be arranged at the inlet of the conveyor dishwasher. Thus, depending on demand, it is for example possible to use handling modules which comprise one or more automated components. As an alternative or in addition, use can be made of one or more handling modules which comprise robots, especially where the partial tasks are too complex for the simple automated component but nevertheless so simple that they can be completed by the robot with high reliability and also with sufficient speed. Other options are also conceivable.

Furthermore, at least one manual workplace for staff can be provided at the conveyor dishwasher in addition to the modular system. In particular, this can be implemented wherever at least one of the partial tasks to be completed is too complex to be processed by handling modules. By way of example, this may be the case where simple automated components cannot be used because the partial task is too complex and, in turn, robots cannot be or should not be used either, for example on account of processing time, capacity, reliability or installation space.

As a result of the modularity and the split of the work to be carried out into partial tasks corresponding to the individual handling function of the handling modules present, it is thus possible to implement a subdivision, especially of the entire processing area between dining room and conveyor dishwasher. On account of the modularity of the proposed system, this subdivision can be configured and operated on an individual basis, and also on a variable basis at the same time.

Furthermore, the modular system also allows the configuration of the modular system to be adapted to the respective demands by the operator themselves. By way of example, it is conceivable for the configuration and composition of the modular system to be altered over a working day, for example by virtue of handling modules being interchanged. Thus, in particular, it is possible to alter the composition in terms of number, type and arrangement of the processing points over the course of the day depending on requirements, in particular depending on the type and/or scope of the washware, for example of the place setting. Thus, in particular, an adaptation can be implemented to the effect of a place setting for breakfast or dinner usually differing significantly from a corresponding place setting at lunchtime, for example in terms of content, composition and scope.

The modular system may also comprise one or more components, for example as handling components, which are already known for similar purposes, for example from the aforementioned prior art. Thus, pushing means or wipers, for example, can be used as handling modules. Alternatively or in addition, it is also possible to use one or more handling modules that comprise flatware-lifting magnets, depending on requirements.

As explained above, the detection module may for example comprise at least one apparatus for image acquisition. The detection module itself and/or the control module may also comprise at least an image evaluation of the image processing. By way of example, the image acquisition means can be arranged at the conveying system for supplying dirtied washware, which may be a constituent part of the proposed cleaning system. Thus, for example, the image acquisition means may be arranged at a feeding belt from the dining room. The image acquisition means and the image processing may for example also recognize disruptive parts on trays and then output an appropriate warning and/or feed the respective washware item, for example the tray with the disruptive part, to a specific handling module which unloads either the disruptive part itself or the entire washware item with the disruptive part, for example a tray with the disruptive part.

The interchangeable handling modules may be designed as universal components, in particular by virtue of having a universal interface which may for example have an analogous form in the case of all interchangeable handling modules. Consequently, the interchangeable handling modules may be designed as a universal interface components.

The modular system and the feeding unit in particular may be configured in such a way that the corresponding washware is fed to the respective handling modules, for example in a defined relative position, for example in the usual relative use position. As explained above, the respective handling module can then carry out its at least one individual handling function for handling the washware, in particular the tableware item, using at least one actuator. By way of example, this individual handling function may comprise at least one of the aforementioned functions, in particular at least one function selected from the group consisting of: turning the washware; emptying and/or clearing the washware, in particular freeing the latter from food remains; providing the washware for reception by the conveying device, in particular the conveyor belt, of the conveyor dishwasher. Thus, the washware in particular, for example the respective tableware item, can be output in the correct relative position and/or correct position and optionally under appropriate time control and at the correct time by the handling module and can be transferred directly or indirectly to the conveying device.

Furthermore, these individual handling functions may also comprise a treatment of the food remains and/or other contaminants of the washware. Thus, it is for example possible to at least partly dispense with subsequent manual steps for removing contaminants and food remains. Thus, at least one individual handling function of at least one handling module may for example consist in a removal of contaminations and/or food remains. Thus, food remains for example can be disposed of when required or continuously on an automated basis, for example by virtue of the respective handling module directly disposing these into a disposable container or disposal shaft and/or by virtue of the respective handling module producing a mass of food remains capable of being pumped and optionally temporarily storing the latter until there is a transfer to a connected disposal system. By way of example, a simple solution for receiving the food remains may be a disposal container such as a refuse can in particular. More complex solutions are also possible, for example a connection between the respective handling module and a centralized refuse disposal means or the like.

By way of example, the handling modules may be adapted to different types of washware. Thus, for example, these may be adapted individually to plates, cups, bowls, trays or flatware. As a result, it is possible in particular also to reduce the amount of work for the staff such that the staff can process a greater number of washware items, in particular tableware items, within the same period of time.

Furthermore, the modular system can be configured to communicate with the conveyor dishwasher in unidirectional or bidirectional fashion. In particular, as explained above, the control module may for example communicate with the conveyor dishwasher and/or even be wholly or partly integrated in the conveyor dishwasher, for example in a central machine controller of the conveyor dishwasher. Alternatively or in addition, the handling modules may also for example communicate with the conveyor dishwasher.

By way of example, such communication between the modular system and the conveyor dishwasher can be used for the purpose of the modular system transmitting information about the state data of the washware and/or the washware situation of the supplied washware to the conveyor dishwasher. Thus, the modular system may for example be configured to transmit numbers of processed tableware amounts to the conveyor dishwasher, for example to the controller of the conveyor dishwasher. Thus, for example the modular system, for example at least one of the handling modules and/or the control module, can transmit to the conveyor dishwasher when no washware is supplied, for example because the place settings have not been fully set. According to this information, the conveyor dishwasher can adjust its operating parameters, for example for saving resources, for example by virtue of the application of cleaning fluid being interrupted temporarily.

By way of example, the handling modules may have such a universal design that the use can be directly or indirectly docked or otherwise connected to the conveyor dishwasher, for example to the inlet of the conveyor dishwasher. In particular, this interface may also comprise a mechanical interface. In particular, the handling modules may be designed in such a way that these can be docked for example to any position on the inlet of the conveyor dishwasher. Docking can be implemented without tools in particular. Furthermore, the handling modules can be designed in such a way that these can be moved from one point to another position, including a corresponding supply with power and/or control signals, preferably likewise without the use of tools.

Furthermore, a plurality of handling modules, which may for example be equipped for different washware, in particular for different tableware, can be arranged next to one another at the inlet of the conveyor dishwasher. Thus, in particular, a single handling module may in each case have the width which the respective piece of washware, in particular tableware, requires on the conveying device, for example the conveyor belt of the conveyor dishwasher, at least to a substantial extent. As a result, the capacity of the conveyor dishwasher is optimized or at least not substantially reduced, in comparison with the situation without the modular system.

In particular, the number and the arrangement of the handling modules can be determined by the number of pieces of washware per unit time, by the requirements of the conveyor dishwasher, in particular the width and the type thereof, and in particular the distribution of the above-described lanes of the conveying device, by the type of washware and, optionally, by the distribution of the amount of washware over the different types of washware. Combinations of the specified factors are also possible.

The situation upstream of the handling modules and/or the equipping of the handling modules can be designed very individually and/or can be designed with only few restrictions. In particular, three variants are conceivable, either on an individual basis or in combination with one another or else in combination with other variants.

By way of example, in a first variant there is a feeding belt, on which the washware in the form of place settings is transported from the dining room to the scullery, for supplying the washware.

By way of example, the feeding belt is guided transversely past the inlet of the conveyor dishwasher. By way of example, a plurality of different handling modules are arranged between the feeding belt and the inlet of the conveyor dishwasher. Additionally, human staff may optionally be provided, who for example take away some items of tableware by hand. By way of example, flatware can be taken off by a handling module using a magnet and the tray can for example be fed to the conveyor dishwasher by a simple handling module in the form of an automated component.

In a second variant, there for example is once again a feeding belt, on which the place settings are transported from the dining room to the scullery. By way of example, the feeding belt is guided transversely past the inlet of the conveyor dishwasher. By way of example, a plurality of different handling modules are arranged in turn between the feeding belt and the inlet of the conveyor dishwasher. A handling module having a robot can for example take the drinking glass from the tray, whereas the human staff for example can take off the remaining tableware by hand. The flatware and the tray are fed to the conveyor dishwasher by one or more further handling modules, for example by one or more simple automation components.

In a third variant, the return situation in the dining room has been altered in relation to the usually existing embodiments, in such a way that the guest returns the constituent parts of the place setting individually. These individual parts are then transported separately in each case to the handling modules and further processed there, as already described above. This variant is conceivable, particularly in cost-sensitive establishments.

Depending on developments in mass catering or else in robot technology, it is also possible to upgrade, retrofit or otherwise change an existing cleaning installation using the modular system.

Accordingly, the installation overall can be adapted to the fluctuating or changing requirements of the operator.

In general, the operator thus has great flexibility in terms of the design and staffing levels in the scullery. Even for future changes, the proposed design offers increased flexibility in comparison with conventional solutions, in particular semi-automated or fully automated installations.

For the cleaning system manufacturer, the proposed solution with the various interchangeable handling modules offers the possibility of developing and producing a plurality of similar handling modules, instead of repeatedly developing and producing new individual specialist apparatuses. Overall, this can increase the profitability, and development costs and production costs can be reduced.

As a result of dividing the processes, there is in particular furthermore success in terms of reducing staffing levels in the scullery and also reducing the load on the staff. Thus, the amount of work for the staff is generally reduced by decomposing the processes into individual steps, and so more pieces of washware, for example more tableware, can moreover be processed within the same period of time. Moreover, decomposing the processing steps into small partial tasks renders possible the use of robots when loading a conveyor dishwasher within the scope of mass catering. The design of the handling modules with the robotic system can be adapted to the respective prior art in such a way that, for example, robot components can be assigned to those tasks which can currently already be processed by robots. With increasing scope of usability, robotic components can receive a greater scope of tasks, and further handling modules with robotic systems can be used without requiring a complete reconfiguration of the system.

In summary and without restricting further possible embodiments, the following embodiments are proposed:

Embodiment 1: A modular system for loading a conveying device of a conveyor dishwasher, comprising:

A. at least one detection module for acquiring state data of supplied washware;

B. a plurality of interchangeable handling modules, the handling modules each being configured to carry out an individual handling function for handling the washware using at least one actuator;

C. at least one feeding unit for selectively feeding the supplied washware to the handling modules;

D. at least one control module, the control module comprising at least one registration unit, the handling modules and the individual handling functions thereof being registrable, and deregistrable, at the registration unit, the control module comprising at least one processor and being configured, by programming, to evaluate the state data and assess a respective washware situation of the supplied washware; and to recognize which handling modules are registered to the registration unit, whether the respective individual handling functions of handling modules are utilizable in the respective washware situation, and to drive the feeding unit in such a way that washware is fed to the handling modules according to utilizability.

Embodiment 2: The modular system according to the preceding embodiment, wherein the individual handling function is selected from the group consisting of:

removing disruptive parts from a tray;

removing food remains and napkins from a tray;

clearing drinking glasses from a tray;

clearing flatware items from a tray;

clearing other tableware items from a tray;

providing supplied trays to the conveying device of the conveyor dishwasher;

turning a removed tableware item over and transferring the latter to the conveying device of the conveyor dishwasher;

forwarding a removed tableware item and transferring the latter to the conveying device of the conveyor dishwasher.

Embodiment 3: The modular system according to any one of the preceding embodiments, wherein the state data comprise image data of the supplied washware.

Embodiment 4: The modular system according to the preceding embodiment, wherein the detection module comprises at least one image acquisition means.

Embodiment 5: The modular system according to one of the two preceding embodiments, wherein the processor has at least one image evaluation software and is configured to recognize and assess the washware situation by means of the image evaluation software.

Embodiment 6: The modular system according to any one of the preceding embodiments, wherein the processor comprises at least one artificial intelligence, in particular at least one artificial neural network, for assessing the washware situation.

Embodiment 7: The modular system according to any one of the preceding embodiments, wherein the control module further is configured to recognize if the respective washware situation requires handling for which no handling module with a suitable individual handling function is registered to the registration unit.

Embodiment 8: The modular system according to the preceding embodiment, wherein the control module is furthermore configured to notify human staff about the lack of handling function by means of a warning, in particular an optical and/or acoustic warning.

Embodiment 9: The modular system according to either of the two preceding embodiments, wherein the control module is furthermore configured to accordingly feed the washware to a workstation for human staff Embodiment 10: The modular system according to any one of the preceding embodiments, wherein the individual handling function comprises a provision of at least one selected type of washware to at least one assigned lane of the conveying device of the conveyor dishwasher.

Embodiment 11: The modular system according to any one of the preceding embodiments, wherein the individual handling function comprises a spatial orientation, in particular a turning, of at least one selected type of washware.

Embodiment 12: The modular system according to any one of the preceding embodiments, wherein the modular system comprises at least one interface, the interchangeable handling modules being capable of being reversibly docked to the interface.

Embodiment 13: The modular system according to any one of the preceding embodiments, wherein the modular system is configured to handle washware comprising trays.

Embodiment 14: The modular system according to the preceding embodiment, wherein the washware comprises trays and tableware items on the tray.

Embodiment 15: The modular system according to any one of the preceding embodiments, wherein the plurality of interchangeable handling modules comprise at least one handling module that is configured to carry out an individual handling function in the form of a removal of disruptive parts from a tray.

Embodiment 16: The modular system according to any one of the preceding embodiments, wherein the plurality of interchangeable handling modules comprise at least one handling module which is configured to carry out an individual handling function in the form of removing food remains and napkins from a tray.

Embodiment 17: The modular system according to the preceding embodiment, wherein the individual handling function furthermore comprises at least a disposal of the food remains and napkins in at least one disposal device.

Embodiment 18: The modular system according to any one of the preceding embodiments, wherein the plurality of interchangeable handling modules comprise at least one handling module that is configured to carry out an individual handling function in the form of clearing drinking glasses from a tray.

Embodiment 19: The modular system according to the preceding embodiment, wherein the individual handling function furthermore comprises at least provision of the drinking glasses to the conveying device of the conveyor dishwasher, selected from the group consisting of: loading the drinking glasses into drinkware dishwasher baskets; placing the drinking glasses on at least one drinkware lane of the conveying device of the conveyor dishwasher.

Embodiment 20: The modular system according to either of the two preceding embodiments, wherein the individual handling function furthermore comprises an emptying of the drinking glasses.

Embodiment 21: The modular system according to any one of the preceding embodiments, wherein the plurality of interchangeable handling modules comprise at least one handling module that is configured to carry out an individual handling function in the form of clearing flatware items from a tray.

Embodiment 22: The modular system according to the preceding embodiment, wherein the individual handling function furthermore comprises a provision of the flatware items to the conveying device of the conveyor dishwasher, selected from the group consisting of: loading the flatware items into flatware dishwasher baskets; placing the flatware items on at least one flatware lane of the conveying device of the conveyor dishwasher.

Embodiment 23: The modular system according to any one of the preceding embodiments, wherein the plurality of interchangeable handling modules comprise at least one handling module that is configured to carry out an individual handling function in the form of clearing at least one type of tableware apart from flatware and drinking glasses from a tray.

Embodiment 24: The modular system according to the preceding embodiment, wherein the individual handling function furthermore comprises a provision of the tableware items to the conveying device of the conveyor dishwasher, selected from the group consisting of: loading the tableware items into tableware dishwasher baskets; placing the tableware items on at least one tableware lane of the conveying device of the conveyor dishwasher.

Embodiment 25: The modular system according to any one of the preceding embodiments, wherein the feeding unit comprises at least one device selected from the group consisting of: a pushing means for selectively pushing constituent parts of the washware to the respective handling modules; a gripper; a brush; a magnet; a slide; a switch; a scraper bar.

Embodiment 26: A cleaning system for cleaning washware, comprising:

a. at least one modular system according to any one of the preceding embodiments;
b. at least one conveyor dishwasher, the conveyor dishwasher comprising at least one cleaning chamber and at least one conveying device for conveying washware from an inlet of the conveyor dishwasher to an outlet of the conveyor dishwasher through the cleaning chamber, the conveyor dishwasher being configured to apply at least one cleaning fluid to the washware in the cleaning chamber; and
c. at least one conveying system for supplying dirtied washware.

Embodiment 27: The cleaning system according to the preceding embodiment, wherein the conveying device is selected from the group consisting of: a conveyor belt, transport casters, in particular driven transport casters, a link chain.

Embodiment 28: The cleaning system according to either of the two preceding embodiments, wherein the conveying system comprises at least one device selected from the group consisting of: a conveyor belt, transport casters, in particular driven transport casters, a link chain.

Embodiment 29: A method for cleaning washware, comprising:

i. providing at least one cleaning system according to any one of the preceding embodiments that relate to a cleaning system;
ii. supplying washware by means of the conveying system;
iii. acquiring state data relating to the supplied washware by means of the detection module;
iv. evaluating the state data and assessing the respective washware situation of the supplied washware by means of the control module;
v. recognizing the handling modules registered to the registration unit and the respective individual handling function of the handling modules, and assessing the utilizability in the respective washware situation; and
vi. driving the feeding unit by way of the control unit in such a way that the handling modules are fed washware in accordance with the utilizability.

BRIEF DESCRIPTION OF THE FIGURES

Further details and features arise from the following description of exemplary embodiments, in particular in conjunction with the dependent claims. In this case, the respective features may be implemented on their own or several may be implemented together in combination. The invention is not restricted to the exemplary embodiments. The exemplary embodiments are represented schematically in the figures. In this case, the same reference signs in the individual figures denote the same or functionally equivalent elements or elements that correspond to one another in respect of their functions.

In detail.

DESCRIPTION OF THE EXEMPLARY EMBODIMENTS

Figure 1:
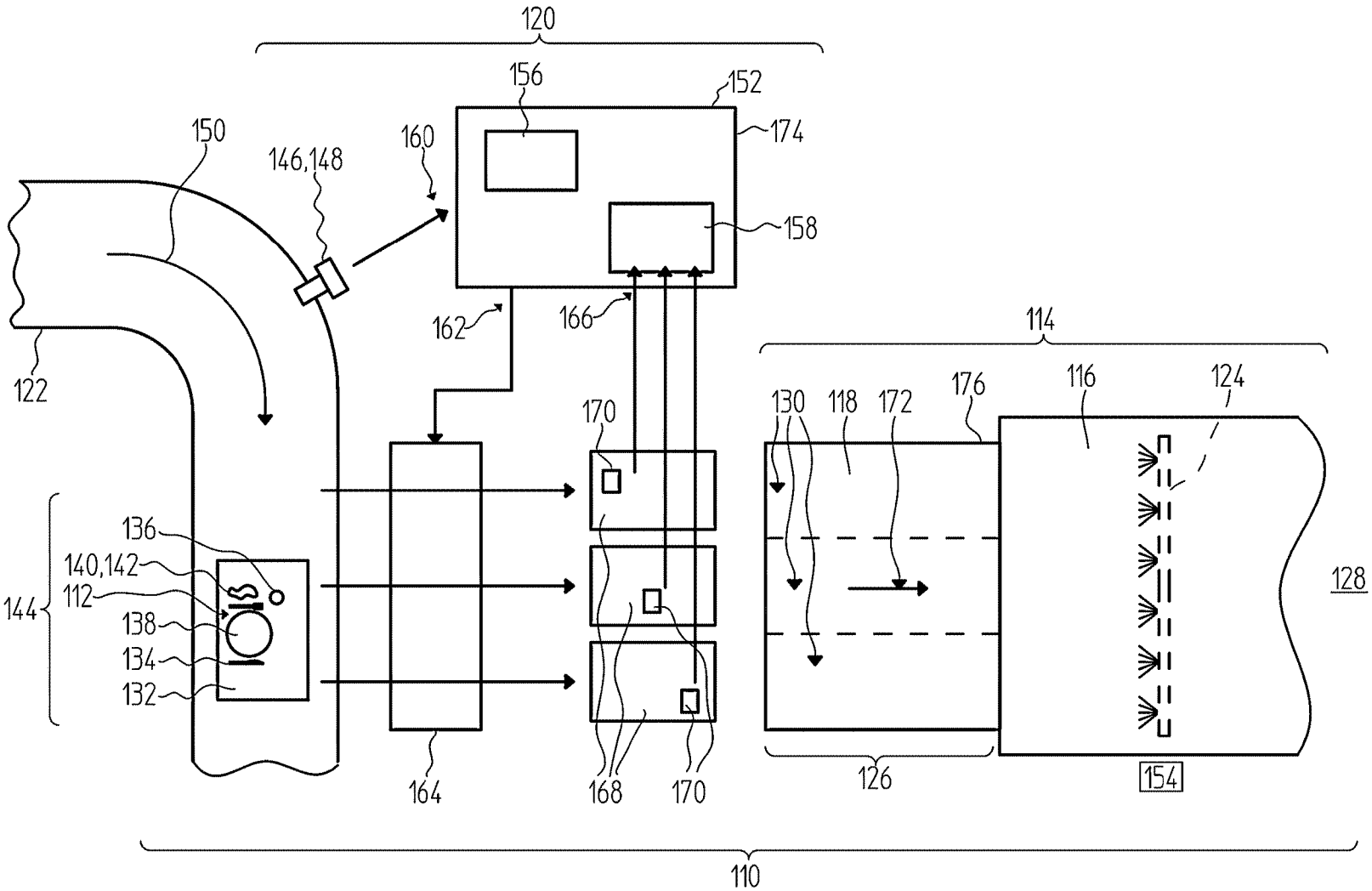
FIG. 1 shows a plan view of an exemplary embodiment of a cleaning system and a modular system.

FIG. 1 shows a plan view of a schematic arrangement of an exemplary embodiment of a cleaning system 110 for cleaning washware 112. By way of example, the cleaning system 110 of this exemplary embodiment comprises a conveyor dishwasher 114 with a cleaning chamber 116 and a conveying device 118 for transporting the washware 112 through the cleaning chamber 116. Furthermore, the cleaning system 110 of the depicted exemplary embodiment comprises a modular system 120 for loading the conveying device 118 of the conveyor dishwasher 114 with washware 112. Furthermore, the cleaning system 110 comprises a conveying system 122 for supplying dirtied washware 112.

The conveyor dishwasher 114 comprises an application device 124 that is depicted schematically in FIG. 1. The application device 124 can be used to apply at least one cleaning fluid to the washware 112 which is transported through the cleaning chamber 116, for example a cleaning zone, by means of the conveying device 118. By way of example, a plurality of cleaning zones, for example at least one pre-clearing zone, at least one washing zone and at least one final rinsing zone and optionally, furthermore, at least one drying zone, may be arranged within the cleaning chamber 116 of the conveyor dishwasher 114, a successive application of cleaning fluid being able to be implemented by way of said cleaning zones. In principle, reference can be made to the aforementioned prior art in respect of possible embodiments of the conveyor dishwasher 114. By way of example, the washware 112 can be conveyed from an inlet 126 of the conveyor dishwasher 114, through the cleaning chamber 116 and to an outlet 128, the latter merely being indicated in FIG. 1. As indicated in FIG. 1, the conveying device 118 may in this case be subdivided into a plurality of lanes 130, which may have a physical or else virtual embodiment. In the case of the physical embodiment, provision can be made of, for example, different types of receptacle on the conveying device 118, for example different links and/or different compartments. Accordingly, the lanes 130 may for example be able to receive different types of washware 112. By way of example, different types of application by the application device 124, for example by way of a different arrangement and/or alignment of nozzles, may be provided, for example within the cleaning chamber 116, for these different types of washware.

By way of example, the conveying system 122 may be designed as a conveyor belt system. By way of example, the washware 112 can be subdivided into units in each case, said units being able to be defined, in particular, by a tray 132 and its content. Thus, for example, flatware 134, drinking glasses 136, different types of tableware 138, and also disruptive parts 140 and/or refuse 142, may be provided on a tray 132 in each case. By way of example, the conveying system 122 may comprise at least one conveyor belt, by means of which the washware 112 can be conveyed to a transfer point 144. By way of example, conveying may be from a dining room to a scullery, and so the transfer point 144 may be arranged in the scullery, for example.

The modular system 120 comprises at least one detection module 146 for acquiring state data of the supplied washware 112. By way of example, the at least one detection module 146 may comprise at least one camera 148 for acquiring image data. By way of example, the detection module 146 may be arranged at one or more acquisition points of the conveying system 122, which need not necessarily be identical to the transfer point 144 and which, for example, may be arranged upstream of the transfer point 144 in relation to conveying direction 150 of the conveying system 122.

The detection module 146 can be unidirectionally or bidirectionally coupled to at least one control module 152 of the modular system 120. Alternatively or in addition, the at least one detection module may also be wholly or partly integrated in said control module 152. By way of example, this control module 152 may also be unidirectionally or bidirectionally coupled to a controller 154 of the conveyor dishwasher 114, this not being depicted in FIG. 1, and/or else may be wholly or partly integrated in this controller 154.

The control module 152 comprises at least one processor 156. Furthermore, the control module 152 comprises at least one registration unit 158. This registration unit 158 may be designed to fully or partly as software and/or fully or partly as hardware. Furthermore, the registration unit 158 may also be fully or partly integrated in the processor 156. The control module 152 may further comprise at least one interface 160 for a connection to the at least one detection module 146, at least one interface 162 for a connection to at least one of the feeding units 164 yet to be described in more detail below, and furthermore at least one interface 166 for reversible coupling to a plurality of handling modules 168.

As mentioned above, the modular system 120 furthermore comprises a plurality of interchangeable handling modules 168. These interchangeable handling modules 168 are each configured to carry out an individual handling function for handling the washware 112 using at least one actuator 170 in each case. Examples of possible actuators are mentioned above and will still be described in more detail below. In particular, this may relate to actuators 170 which have a magnetic function, which have a mechanical function or which have for example a disposal function. The actuators 170 can in particular facilitate a transfer of certain types of washware 112 to the conveying device 118, in particular with a given orientation. Following this transfer, the washware 112 can then be transported through the cleaning chamber 116 in a conveying direction 172 by means of the conveying device 118. The individual handling functions of the handling modules 168 may for example relate to certain types of washware 112 and/or to certain handling to be carried out, for example emptying food remains from the washware 112 and/or a disposal of refuse.

The handling modules 168 are reversibly couplable to the modular system 120 and are also decouplable therefrom again. Thus, the modular system 120 can be configured individually for the respective use and can be flexibly reconfigured. Thus, the at least one interface 166 may for example comprise at least one mechanical interface, which may for example be arranged on the housing 174 of the modular system 120 and/or which may wholly or partly also be arranged on a housing 176 of the conveyor dishwasher 114. In the process, there may be mechanical and/or electric or electronic coupling. These functions of the interface may also be formed separately such that, for example, there can be mechanical coupling to the conveyor dishwasher 114, whereas coupling for unidirectional or bidirectional interchange of data and/or control commands and/or an electrical supply can be implemented by way of the at least one interface 166 on the housing 174. Furthermore, the latter interface 166 in particular may have a wired or else a wholly or partly wireless design, for example within the scope of coupling to an Internet of things (IoT). Various designs are conceivable and known to a person skilled in the art as a matter of principle. In the registration unit 158, the respectively coupled handling modules 168 are registrable and can also be deregistered again in the case of decoupling. By way of example, the application unit may comprise at least one directory or register, in which the currently registered handling modules 168 are recorded. Furthermore, the respective individual handling functions of the registered handling modules 168 are also recorded in the registration unit.

Furthermore, the modular system 120 comprises the at least one feeding unit 164. This feeding unit 164 is configured to feed washware 112 to the handling modules 168 in accordance with the usability thereof. In principle, this feed is implemented in such a way that the respective washware 112 and the respective handling module 168 are brought closer to one another such that, for example, the washware 112 and/or the respective handling module 168 can be moved. By way of example, the feeding unit 164 may comprise at least one pushing means which selectively feeds certain washware 112 to an associated handling module 168.

By programming, the processor 156 of the control module 152 is configured in such a way that the state data, which are supplied by the detection module 146, are evaluated, and a respective washware situation of the supplied washware 112, for example for a tray 132 and content in each case, is evaluated and assessed. Furthermore, the processor 156 is configured by programming to recognize which handling modules 168 are currently registered to the registration unit 158, for example by querying the directory or register of the registration unit 158. The processor 156 is furthermore configured to recognize whether the respective individual handling functions of these registered handling modules 168 are usable in the respective washware situation. Accordingly, the processor 156 is configured to drive the feeding unit 164 in such a way that, should usability be recognized, washware 112 is accordingly fed to the respective handling modules 168. By way of example, should the registration of a handling module 168 for handling flatware 134 be recognized, it is possible to feed flatware 134 to this handling module 168 in a targeted manner. This flatware 134 can be fed to the handling module 168 using at least one magnetic actuator. By way of example, the handling module 168 can place the flatware 134 on a specific flatware lane of the lanes of a conveying device 118 and/or collect said flatware in one or more flatware baskets or flatware receptacles. By way of example, should the registration of a handling module 168 for handling plates or other types of tableware 138 be recognized, it is possible to feed tableware to this handling module 168 in a targeted manner. By way of example, these tableware parts can be grasped by a gripping or suction means, can be freed from food remains and can be placed with a correct orientation on the conveying device 118. By way of example, analogous procedures may also be carried out for other types of washware 112.

The control module 152 is able to react in various ways should the need for individual handling functions or handling steps for which no handling module 168 is registered be recognized during the evaluation of the washware situation by the control module 152 and during a corresponding comparison with the registered handling modules 168. By way of example, a warning can be output to human staff, for example an acoustic and/or an optical warning, using at least one warning device of the cleaning system 110 and/or of the modular system 120. Alternatively or in addition, the corresponding washware 112 can also be unloaded, for example to a specific manual workplace and/or to a holding position. Human staff can then undertake the appropriate work steps there. Thus, for example, corresponding trays 132 with a load which require steps that cannot be carried out by registered handling modules 168 can for example simply be conveyed onward by means of the conveying system 122 until human staff can deal with the completion of the corresponding tasks.

Figure 2:
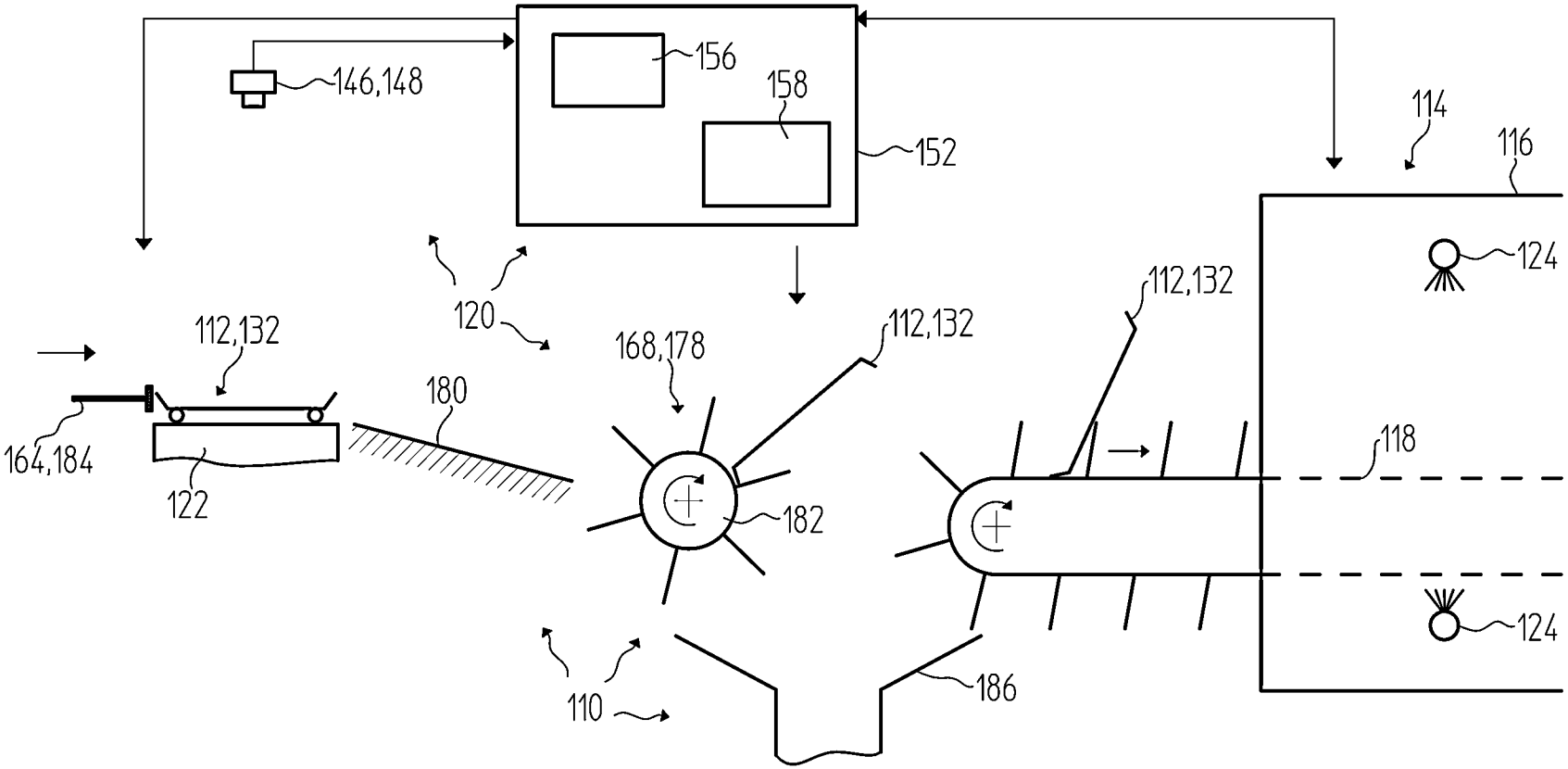
FIG. 2 shows a further exemplary embodiment of a cleaning system and a modular system in a sectional representation from the side.

FIG. 2 shows an example of a cleaning system 110 having the modular system 120 in a schematic sectional representation from the side. In this case, only one single handling module 168 is shown in exemplary fashion. Otherwise, reference can be made in large parts to the description of FIG. 1. In this case, the handling module 168 is designed as a tray turner 178 by way of example. Alternatively or in addition, provision can also be made of at least one plate turner, for example. By way of example, the tray turner shown here may comprise a feeding ramp 180, and furthermore a turning wheel 182. After the tray 132 has been cleared by preceding handling modules 168 and/or by human staff, a pushing means 184 of the feeding unit 164 can for example push the empty tray 132 to the feeding ramp 180, by means of which the tray 132 is then inserted into the turning wheel 182. Refuse is initially removed there by means of a rotation by way of the turning wheel 182, it being possible for example to dispose of said refuse into a disposal shaft 186. As a result of a further rotation, the tray 132 can be inserted for example into corresponding compartments, formed by the fingers 188, of the conveying device 118, for example on a lane 130 provided to this end or on a tray lane. Different types of handling modules 168, for example with other individual handling functions, can be used as an alternative or in addition to the handling module 168 shown in FIG. 2.

Figure 3:
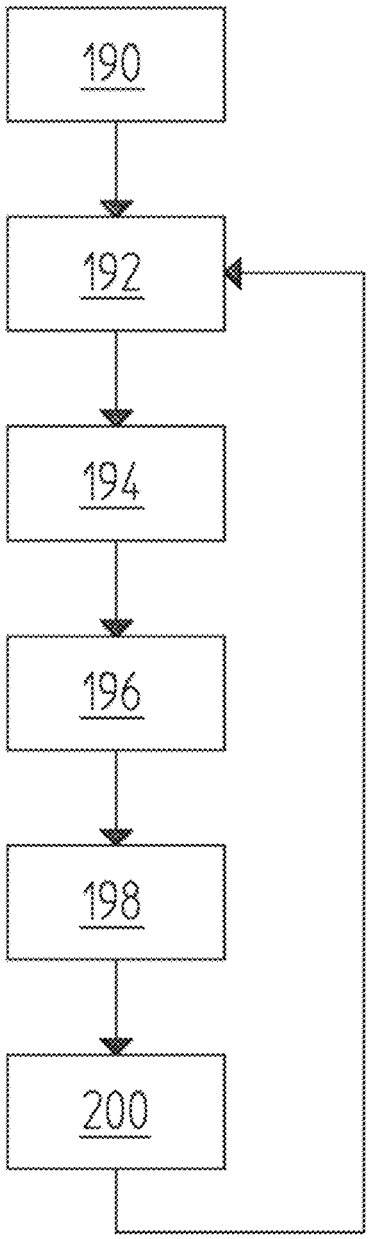
FIG. 3 shows a flowchart of an exemplary embodiment of a method for cleaning washware.

FIG. 3 shows a schematic procedure of an exemplary embodiment of a method for cleaning washware 112. In a step 190, the method comprises a provision of a cleaning system 110, for example in accordance with the representation in FIG. 1. Furthermore, the method comprises a step in which washware 112 is supplied by means of the conveying system 122. Furthermore, the method comprises a step 194 in which state data of the supplied washware 112 are acquired by means of the detection module 146. Furthermore, the method comprises a step 196 in which the state data are evaluated and the respective washware situation of the supplied washware 112 is assessed by means of the control module 152. As explained above, this may for example be implemented in each case for a tray 132 with further washware 112 thereon. Furthermore, the method comprises a step 198 in which the handling modules 168 registered to the registration unit 158 and their respective individual handling functions are recognized, especially by the control module 152, and in which the utilizability of the registered handling modules 168 for the respective washware situation is assessed. Furthermore, the feeding unit 164 is driven by the control module 152 in such a way in a step 200 that washware 112 is fed to the handling modules 168 in accordance with their utilizability. Subsequently, as illustrated in FIG. 3, the method can be repeated in full or in part, for example by virtue of carrying out the method steps again starting from step 192. Alternatively, however, the method steps may already run in parallel such that, for example, steps 192 and 194 are already carried out anew with the next tray 132 while the preceding trays 132 are still processed. In respect of further possible embodiments of the method, reference can be made to the description, given above, of the cleaning system 110 and of the modular system 120.

LIST OF REFERENCE SIGNS

110 Cleaning system
112 Washware
114 Conveyor dishwasher
116 Cleaning chamber
118 Conveying device
120 Modular system
122 Conveying system
124 Application device
126 Inlet
128 Outlet
130 Lane
132 Tray
134 Flatware
136 Drinking glass
138 Tableware
140 Disruptive part
142 Refuse
144 Transfer point
146 Detection module
148 Camera
150 Conveying direction
152 Control module
154 Controller
156 Processor
158 Registration unit
160 Interface
162 Interface
164 Feeding unit
166 Interface
168 Handling module
170 Actuator
172 Conveying direction
174 Housing
176 Housing
178 Tray turner
180 Feeding ramp
182 Turning wheel
184 Pushing means
186 Disposal shaft
188 Finger
190 Provision of a cleaning system
192 Supplying the washware
194 Acquiring state data
196 Evaluating the state data
198 Recognizing the registered handling modules
200 Driving the feeding unit

The invention claimed is:

1. A modular system for loading a conveying device of a conveyor dishwasher, comprising:

A. at least one detection module for acquiring state data of supplied washware;

B. a plurality of interchangeable handling modules, the handling modules each being configured to carry out an individual handling function for handling the washware using at least one actuator;

C. at least one feeding unit for selectively feeding the supplied washware to the handling modules;

D. at least one control module, the control module comprising at least one registration unit, the handling modules and the individual handling functions thereof being registrable, and deregistrable, at the registration unit, the control module comprising at least one processor and being configured, by programming, to evaluate the state data and assess a respective washware situation of the supplied washware; and to recognize which handling modules are registered to the registration unit, whether the respective individual handling functions of handling modules are utilizable in the respective washware situation, and to drive the feeding unit in such a way that washware is fed to the handling modules according to utilizability.

2. The modular system as claimed in claim 1, wherein the individual handling function is selected from the group consisting of:

removing disruptive parts from a tray;
removing food remains and napkins from a tray;
clearing drinking glasses from a tray;
clearing flatware items from a tray;
clearing other tableware items from a tray;
providing supplied trays to the conveying device of the conveyor dishwasher;
turning a removed tableware item over and transferring the latter to the conveying device of the conveyor dishwasher;
forwarding a removed tableware item and transferring the latter to the conveying device of the conveyor dishwasher.

3. The modular system as claimed in claim 1, wherein the state data comprise image data of the supplied washware, the processor having at least one image evaluation software and being configured to recognize and assess the washware situation by means of the image evaluation software.

4. The modular system as claimed in claim 1, wherein the processor comprises at least one artificial intelligence for assessing the washware situation.

5. The modular system as claimed in claim 1, wherein the control module further is configured to recognize if the respective washware situation requires handling for which no handling module with a suitable individual handling function is registered to the registration unit.

6. The modular system as claimed in claim 1, wherein the individual handling function comprises a provision of at least one selected type of washware to at least one assigned lane of the conveying device of the conveyor dishwasher.

7. The modular system as claimed in claim 1, wherein the modular system comprises at least one interface, the interchangeable handling modules being capable of being reversibly docked to the interface.

8. The modular system as claimed in claim 1, wherein the plurality of interchangeable handling modules comprises at least one handling module that is configured to carry out an individual handling function in the form of a removal of disruptive parts from a tray.

9. The modular system as claimed in claim 1, wherein the plurality of interchangeable handling modules comprises at least one handling module that is configured to carry out an individual handling function in the form of a removal of food remains and napkins from a tray, the individual handling function furthermore comprising at least a disposal of the food remains and napkins in at least one disposal device.

10. The modular system as claimed in claim 1, wherein the plurality of interchangeable handling modules comprises at least one handling module that is configured to carry out an individual handling function in the form of clearing drinking glasses from a tray, the individual handling function furthermore comprising at least a provision of the drinking glasses to the conveying device of the conveyor dishwasher, selected from the group consisting of: loading the drinking glasses into drinkware dishwasher baskets; placing the drinking glasses on at least one drinkware lane of the transporting device of the conveyor dishwasher.

11. The modular system as claimed in claim 1, wherein the plurality of interchangeable handling modules comprises at least one handling module that is configured to carry out an individual handling function in the form of clearing flatware items from a tray, the individual handling function furthermore comprising at least a provision of the flatware items to the conveying device of the conveyor dishwasher, selected from the group consisting of: loading the flatware items into flatware dishwasher baskets; placing the flatware items on at least one flatware lane of the transporting device of the conveyor dishwasher.

12. The modular system as claimed in claim 1, wherein the plurality of interchangeable handling modules comprises at least one handling module that is configured to carry out an individual handling function in the form of clearing at least one type of tableware items apart from flatware and drinking glasses from a tray, the individual handling function furthermore comprising at least a provision of the tableware items to the conveying device of the conveyor dishwasher, selected from the group consisting of: loading the tableware items into tableware dishwasher baskets; placing the tableware items on at least one tableware lane of the transporting device of the conveyor dishwasher.

13. The modular system as claimed in claim 1, wherein the feeding unit comprises at least one device selected from the group consisting of: a pushing means for selectively pushing constituent parts of the washware to the respective handling modules; a gripper; a brush; a magnet; a slide; a switch; a scraper bar.

14. A cleaning system for cleaning washware, comprising:

a. at least one modular system as claimed in claim 1;

b. at least one conveyor dishwasher, the conveyor dishwasher comprising at least one cleaning chamber and at least one conveying device for conveying washware from an inlet of the conveyor dishwasher to an outlet of the conveyor dishwasher through the cleaning chamber, the conveyor dishwasher being configured to apply at least one cleaning fluid to the washware in the cleaning chamber; and c. at least one conveying system for supplying dirtied washware.

15. A method for cleaning washware, comprising:

i. providing at least one cleaning system as claimed in claim 14;

ii. supplying washware by means of the conveying system;

iii. acquiring state data relating to the supplied washware by means of the detection module;

iv. evaluating the state data and assessing the respective washware situation of the supplied washware by means of the control module;

V. recognizing the handling modules registered to the registration unit and the respective individual handling function of the handling modules, and assessing the utilizability in the respective washware situation; and vi. driving the feeding unit by way of the control unit in such a way that the handling modules are fed washware in accordance with the utilizability.

* * * * *